US005137415A

United States Patent [19]

Doeberl et al.

[11] Patent Number: 5,137,415

[45] Date of Patent: Aug. 11, 1992

[54] POWER STACKING APPARATUS

[75] Inventors: Terrence M. Doeberl, West Redding; Ralph K. Rand, Sandy Hook, both of Conn.; Larry S. Payne, Farmers Branch, Tex.; Kazutoshi Fujimoto, Arlington, Tex.; William C. Monday, Rowlett, Tex.

[73] Assignee: Pitney Bowes Inc., Stamford, Conn.

[21] Appl. No.: 565,878

[22] Filed: Aug. 13, 1990

Related U.S. Application Data

[63] Continuation of Ser. No. 291,036, Dec. 28, 1988, abandoned.

[51] Int. Cl.[5] ..... B65G 57/11

[52] U.S. Cl. ..... 414/798.5; 271/184; 271/215

[58] Field of Search ..... 271/2, 179, 181, 189, 271/212, 215, 216, 184; 414/798.2, 798.5

[56] References Cited

U.S. PATENT DOCUMENTS

| | | | |
|---|---|---|---|
| 2,238,010 | 4/1941 | Breman | 271/87 |
| 2,841,394 | 7/1958 | Stobb | 271/214 X |
| 2,843,378 | 7/1958 | Faeber | 271/87 |
| 3,131,932 | 5/1964 | Maidment | 271/215 X |
| 3,700,232 | 10/1972 | Wiegert et al. | 271/75 |
| 3,865,365 | 2/1975 | Hardin et al. | 414/798.5 X |
| 4,200,016 | 4/1980 | Helmig et al. | 83/88 |
| 4,428,573 | 1/1984 | Denison, III et al. | 271/185 X |
| 4,474,365 | 10/1984 | DiBlasio | 271/215 X |

FOREIGN PATENT DOCUMENTS 3246112 7/1983 Fed. Rep. of Germany .

*Primary Examiner*—Robert J. Spar
*Assistant Examiner*—Janice Krizek
*Attorney, Agent, or Firm*—Charles G. Parks, Jr.; David E. Pitchenik; Melvin J. Scolnick

[57] ABSTRACT

A power stacker for collecting delivered articles such as envelopes from a mailing machine is comprised of a support housing having a deck fixably mounted along the housing. A registration wall is fixably mounted to the housing and extending generally perpendicular relative to the deck. A stack wall is slidably mounted to the housing at one end of the deck and has a reclined surface extended generally upwardly from the deck, the stack wall being slidably mounted to the housing such that the stack wall can be horizontally displaced relative to the deck. Support rods are provided for providing article support between the deck and displaced stack wall as well as between the registration and displaced stack wall. Threaded hubs are provided for causing the delivered articles to be collected against the stack wall and assume a generally parallel stacked orientation generally parallel to the reclined surface.

2 Claims, 5 Drawing Sheets

POWER STACKING APPARATUS

This application is a continuation of application Ser. No. 291,036, filed Dec. 28, 1988, now abandoned.

BACKGROUND OF THE INVENTION

This invention relates to stacking apparatus for singularly receiving a stream of articles and causing the articles to be placed in a stack.

It is known, for example, in mail processing systems to use a drop power stacker for receiving envelopes ejected from a mailing machine. A conventional drop power stacker is generally a fixed length apparatus and includes a receiving deck mounted throughout to a base. Conventionally the power stacker is supportably placed on a table abutting at one end to a mailing machine.

In one such conventional power stacker, envelopes ejected from the mailing machine are drop fed onto the deck of the power stacker. The power stacker includes one or more endless belts for advancing the envelopes along the stacker deck. The endless belts are driven at a rate of speed chosen to cause the received envelopes to assume a shingled alignment along the stacker deck. A rotatively driven wheel is mounted to the power stacker to engage a portion of the upper envelopes' surface to assist in providing the proper shingling drive force to the envelopes. As the envelopes encounter the power stacker end wall, shingle space compression accrues causing the envelopes to assume a fan orientation characterized by fan or shingle angle. As a result the capacity of the power stacker in addition to its length its maximum shingle angle.

SUMMARY OF THE PRESENT INVENTION

It is an object of the present invention to present a power stacker which has a substantially reduced foot print and is characterized by increased capacity.

It is a further objective of the present invention to present a power stacker not subject to shingle angle limitations.

A power stacker in accordance with the present invention is comprised of a base section having transversely spaced apart rear and forward walls and enclosing end walls. A plurality of vertically extending support posts are fixably mounted at one end to the base of the power stacker and support, in conjunction with the forward, rear and end walls, a deck such that the deck is placed at a rearwardly reclining angle of approximately 15° (fifteen degrees). A registration wall is fixably mounted generally vertical along the rear wall of the power stacker such that the registration wall assumes a generally perpendicular orientation with respect to the deck.

The deck includes a plurality of parallel aligned slots extending longitudinally. A first and second shaft is rotatively mounted to the underside of the deck in longitudinal spaced apart relationship. Each shaft includes a plurality of friction rollers fixably mounted around the shaft vertically aligned to a respective slot in the deck. An endless belt is placed around a respective pair of friction rollers.

One of the end walls includes a plurality of threaded hubs (augers) rotatively mounted thereto. Each hub extends partially through a recess formed in the deck. A bevel gear is fixably mounted to one end of each of the hub in mesh with a respective bevel gear fixably mounted to the first shaft. The first shaft is driven by a motor fixably mounted to the underside of the housing.

An additional threaded hub is rotatively mounted to the registration wall such that a portion extends through a slot formed in the registration wall. A end portion of the first shaft extends through an aperture in the rear wall of the stacker base. An endless belt communication threaded hub is mounted to the registration wall with the first shaft.

A stack wall is slidably mounted to forward and rear walls abutting the other end wall. The stack wall includes a forward facing surface aligned opposite to the end wall and a reclined surface extending generally vertically from the facing surface. A plurality of rods are fixably mounted at one to the stack wall and extends through end wall apertures. Each rod is slidably mounted longitudinally to the underside of the deck. The power stacker further includes a yoke pivotally mounted to the registration wall having a rotatably mounted wheel in bearing contact with the belts.

Envelopes are received by the power stacker and transported by the belts to the stack wall whereupon the threaded hubs engage the envelopes. The hub engagement of the envelopes forcibly causes the envelope to assume a generally vertical biased position against the stack wall causing the stack wall to journey outward in response to forced engagement of the envelopes.

Other benefits and advantages of the present invention will be noted or be apparent to one reasonable skilled in the art upon a reading of the following detailed description of the preferred embodiment of the invention.

DETAILED DESCRIPTION OF THE PREFERRED EMBODIMENT

Figure 1:
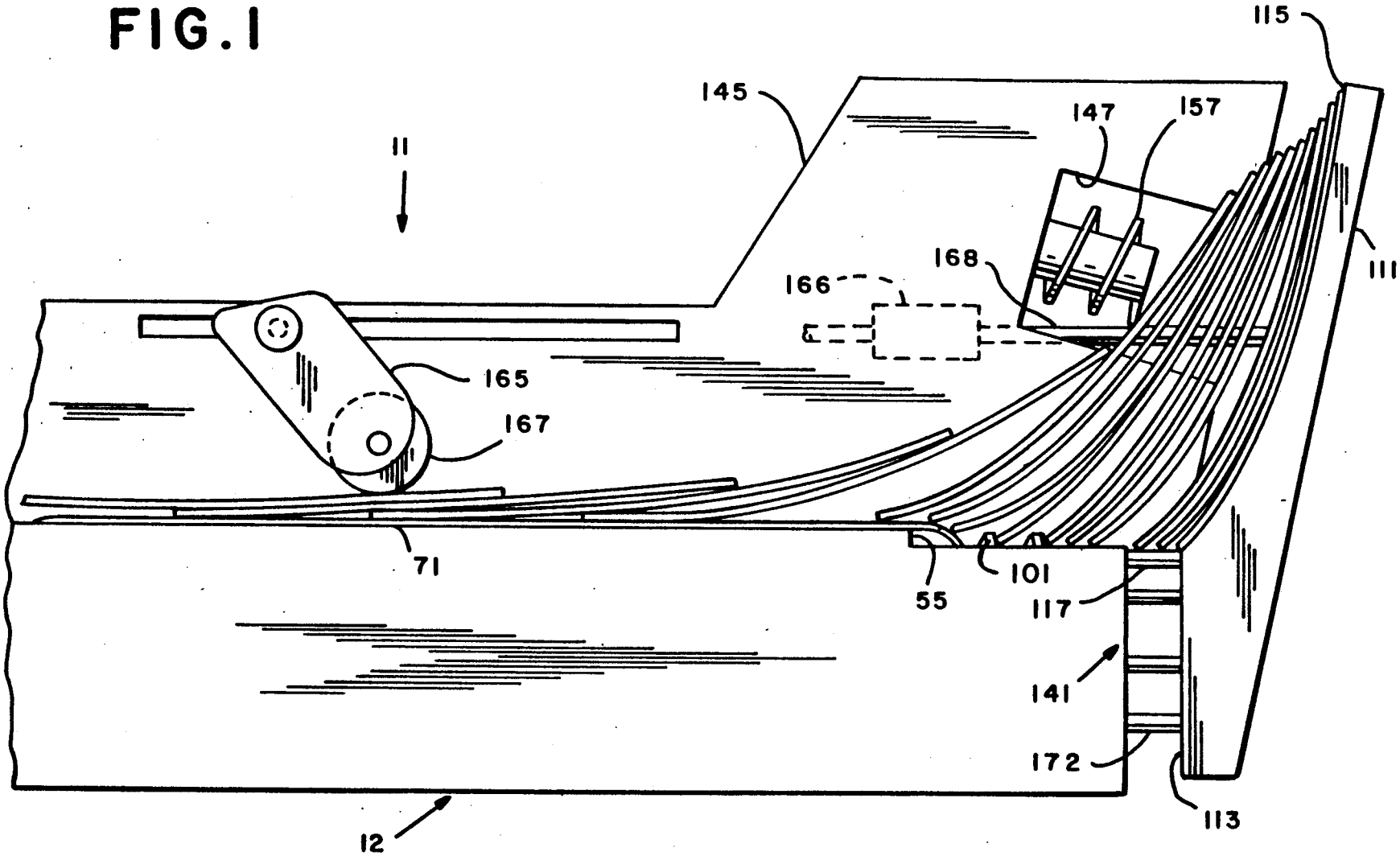
FIG. 1 is a partial side view of a power stacker in accordance with the present invention.

Referring to FIGS. 1 through 4, the power stacker, generally indicated at 11, is comprised of a base housing 12 having a base 13. A plurality of vertically extending support posts 15 and 17 (support post 17 shown in FIG. 3) are fixably mounted to base 13 at one end. The base 13 also has fixably mounted thereto in vertical alignment, a forward wall 21 and rear wall 23 in transversely spaced apart parallel alignment. End walls 25 and 27 are fixably mounted to the base 13 in spaced apart relationship and at there ends to respective walls 21 and 23.

A deck is fixably mounted to walls 21, 23, 25 and 27 and along its underside to the support posts 15 and 17, such that the deck assumes a reclined position, front to rear, of approximately 15° (fifteen degrees) from the horizontal. A deck 31 contains a plurality of slots 33, 35, and 37. Fixably mounted to the underside of the deck 31 at the receiving or forward end is a first and second adjustable tension brace assemblies 41 and 43. Also fixably mounted to the underside of the deck 31 are braces 45. The braces 45 are longitudinally aligned to a respective brace assembly 41 and 43.

Fixably mounted to the underside of deck 31 is a motor mount 48 having a motor 49 mounted thereto. The motor 49 includes an output shaft 51 having a pulley gear 52 fixably mounted around the output shaft 51. A shaft 53 carrying a plurality of fixably mounted friction wheels 55, 57, and 59 therearound is rotatively mounted in the braces 45. The friction wheels are radially aligned to respective first slots 33, 35 and 37. A second shaft 63 is rotatively mounted in brace assemblies 41 and 42. The shaft 63 carries a plurality of friction wheels 65, 67 and 69 radially aligned to the respective second slots 33, 35 and 37. A plurality of endless belts 71, 73, and 74 extend around the respective friction wheel pairs 55–67, 59–65 and 57–69.

The shaft 53 further includes a pulley gear 81 which is in endless belt 83 communication with the motor 49 for providing driving force to shaft 53. The shaft 53 further includes bevel gears 85 and 87 fixably mounted therearound in axially spaced apart relationship. The rear wall 23 includes an aperture 89 through which an end portion of the shaft 53 extends and has fixably mounted therealong a pulley 91.

End wall 25 has formed thereon a plurality of studs 91 and 93 through which extends a respective shaft 95 and 97 seated at one end in the end wall 25. Rotatively mounted around the other end of shafts 95 and 97 is a respective threaded hub 101 and 103. The threaded hubs 101 and 103 are mounted such that the threaded hubs 101 and 103 partially extend into respective recesses 104 and 106 formed into the deck 31. A bevel gear 92 and 93 is rotatively mounted around the respective shafts 95 and 97 in driving communication with the respective threaded hubs 101 and 103. The bevel gears 92 and 93 are in constant mesh with respective bevel gears 85 and 87.

Figure 2:
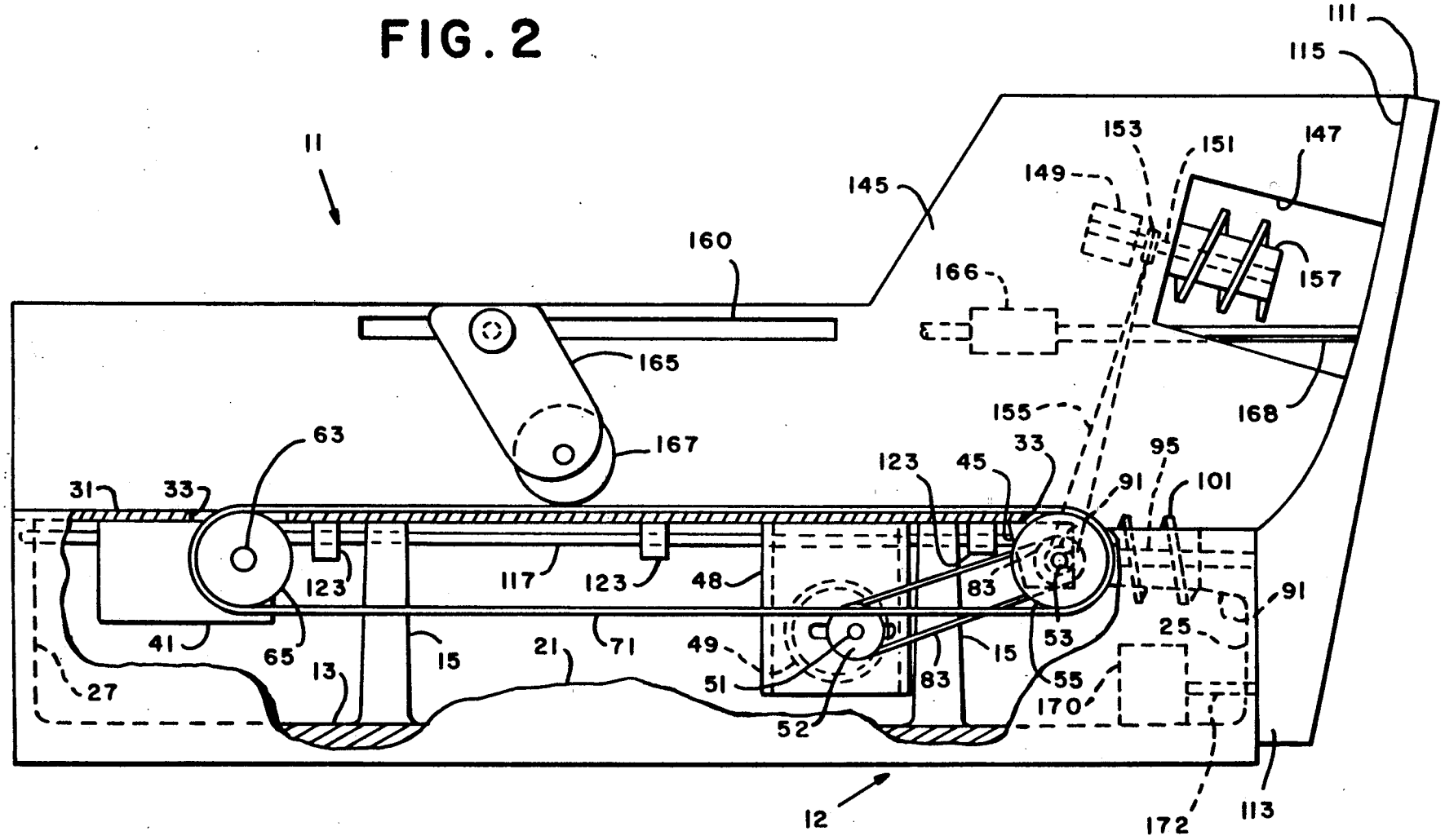
FIG. 2 is a sectioned side view of the power stacker.
Figure 3:
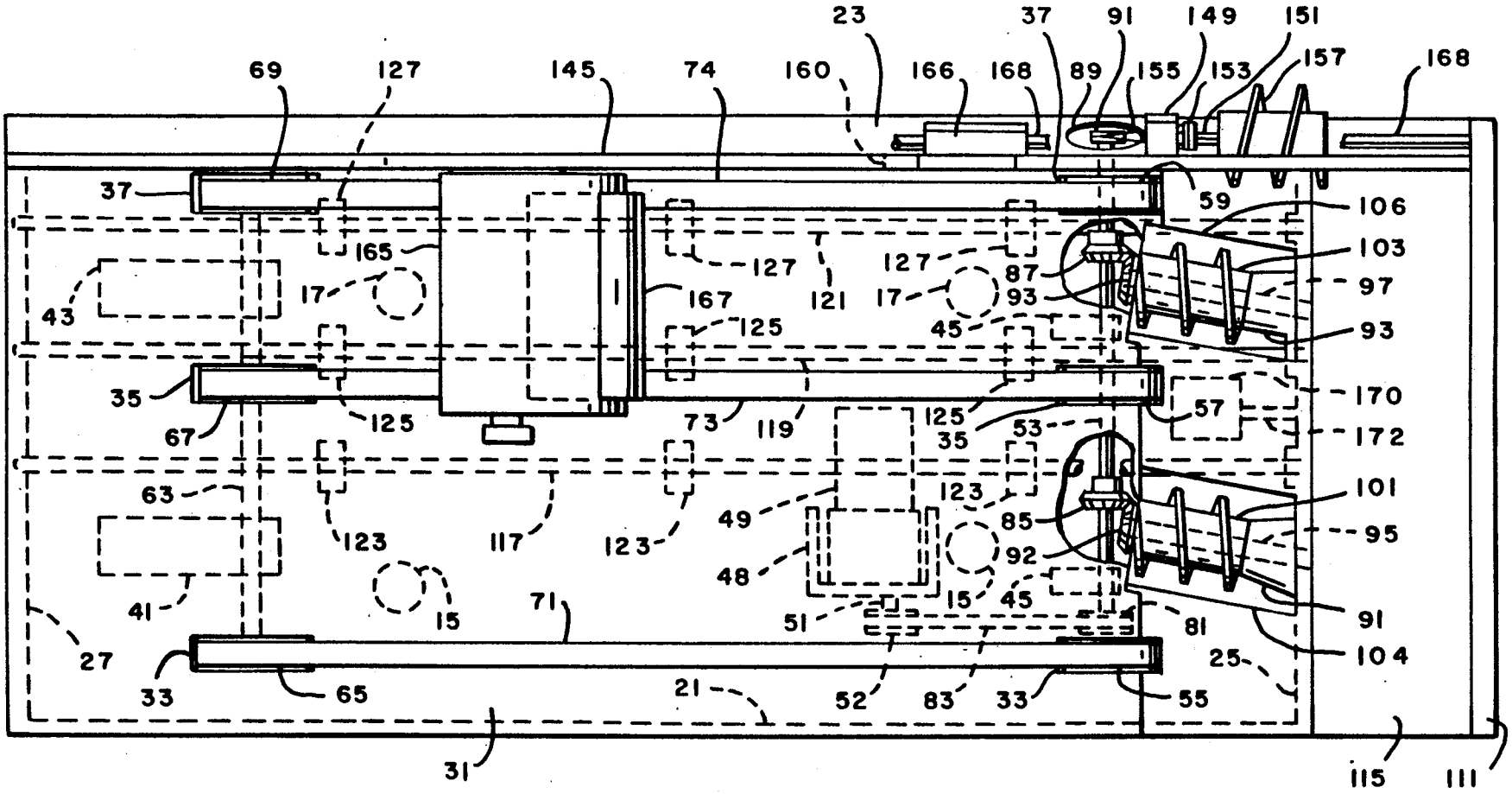
FIG. 3 is a top view of the power stacker.
Figure 4:
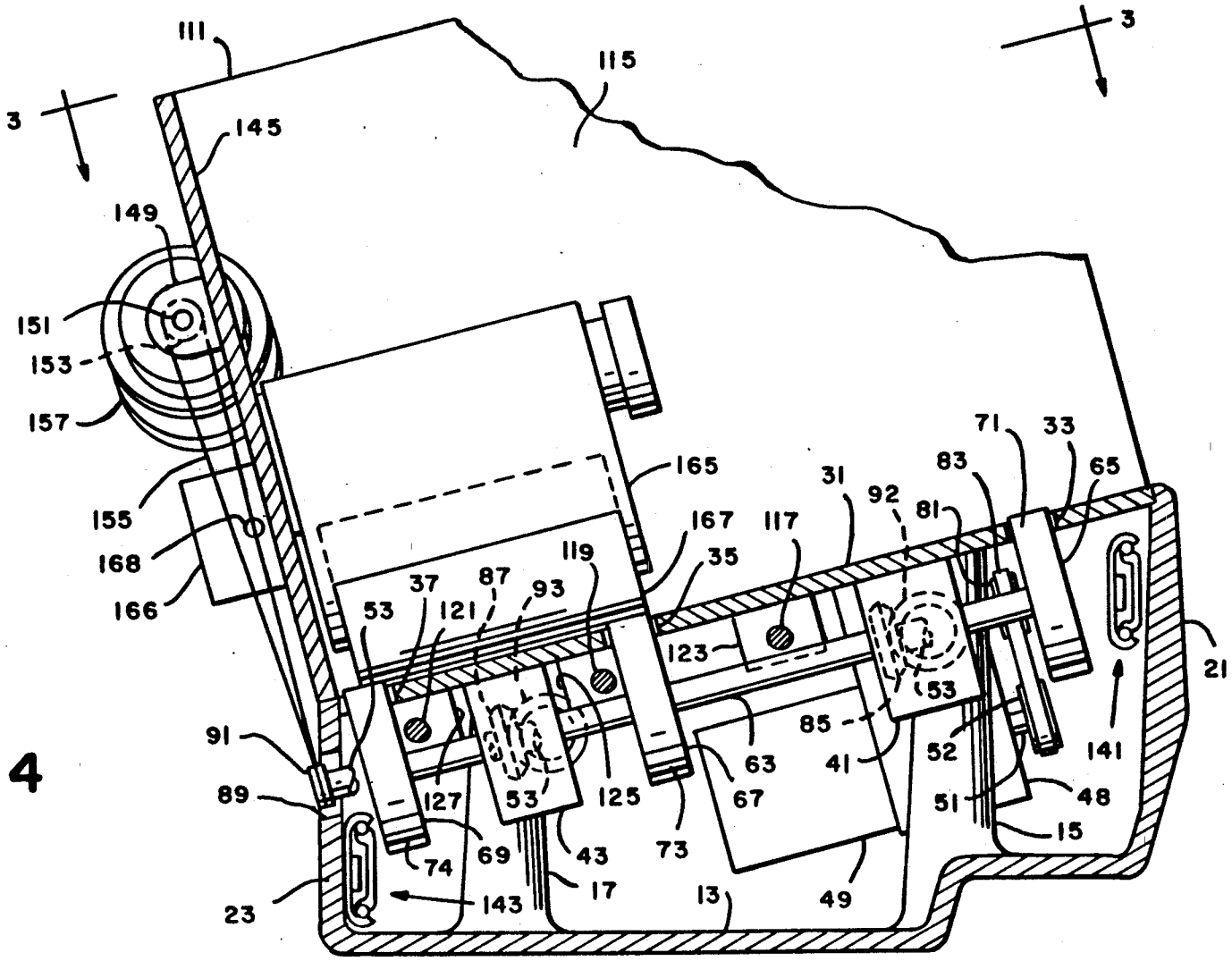
FIG. 4 is a sectioned end view of the power stacker.

A stack wall 111 has a formed facing surface 113 abutting to the outer face of end wall 25 vertically leading to a vertically reclined surface 115. A plurality of guide rods 117, 119, and 121 are fixably mounted at one end to the facing surface of the stack wall 111. The guide rods 117, 119, and 121 extend slidably through respective apertures in the end wall and are slidably received by respective guide tabs 123, 125, and 127. The guide tabs 123, 125, and 127 are fixably mounted to the underside of the deck. Referring particularly to FIGS. 2 and 4, slide rail assemblies 141 and 143 having a rail portion is fixably mounted to the respective side walls 21 and 23. Another rail portion of rail assemblies 141 and 143 are fixably mounted at one end to the facing surface 113 of the stack wall 111 such that the stack wall 111 can be longitudinally displaced relative to end wall 27.

Referring more particularly to FIGS. 2 and 4, a registration wall 145 is fixably mounted longitudinally along the rear wall 23 and orientated generally perpendicular to the deck. The registration wall 145 includes a recess 147 angled generally perpendicular to the reclined surface 115 of stack wall 111. A brace 149 is fixably mounted to the back surface of the registration wall 145. The brace 149 includes a shaft 151 rotatively mounted therein such that the shaft 151 extends generally perpendicular to the recline surface 115 of the stack wall 111. A pulley 153 is fixably mounted to the of shaft 151. The pulley 153 is an endless belt 155 in driven communication with the pulley 91 mounted shaft 63. A threaded hub 157 is fixably mounted around the shaft 151.

The registration wall 145 further includes a slot 160. A yoke 165 is pivotally mounted in slot 160 to the registration wall 145. The yoke 165 carries a yoke wheel 167 rotatively mounted between the forks of the yoke 165. The yoke 165 is adjustably mounted in slot 160 such that the yoke wheel rests on the deck 31. Also fixably mounted to the back face of the registration wall 145 is a guide rod 168 which extends slidably through a slide member 166 fixably mounted to the registration wall 145 and pivotally mounted at one end to the stack wall 111. A return spring assembly 170 is fixably mounted to base 13 having one end of its flex strip 172 fixably mounted to the stack wall 111.

Figure 5:
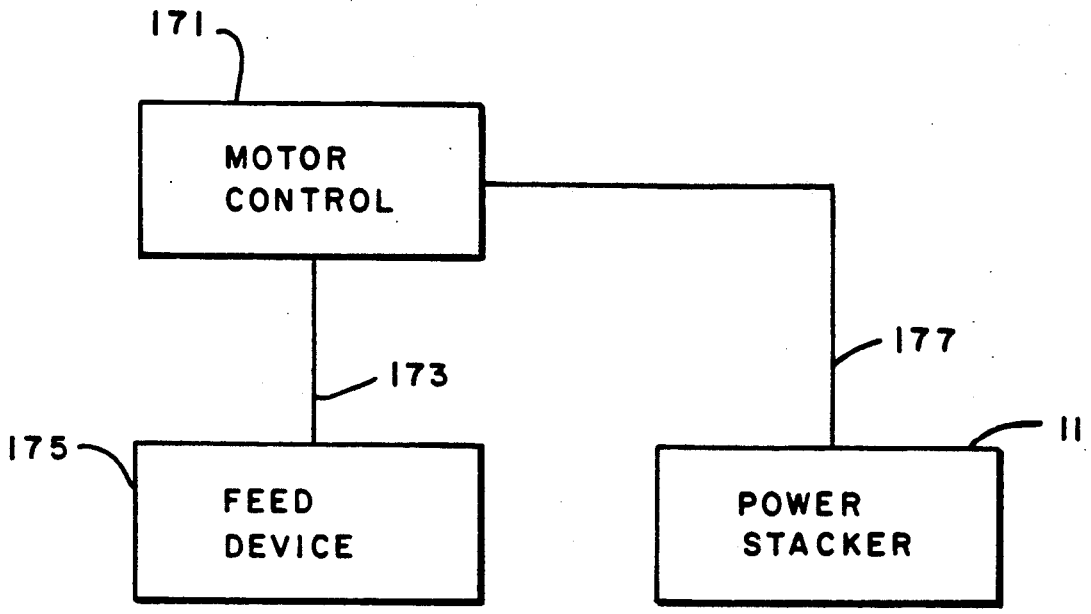
FIG. 5 is a schematic of a power stacker motor control in accordance with the present invention.

Referring to FIGS. 1, 2, and 5, in operation, a suitable motor controller 171 is in electrical communication through line 173 with a envelope feed device 175, for example, a mailing machine, and through line 177 with the motor 49 of the power stacker 12. The motor 171 controller synchronously controls the operating speed of the power stacker 11 and the feed device 175 such that envelopes, for example, 5 inch envelopes delivered by the feed device are received by the power stacker in a shingled fashion with approximately a 0.75 inch spacing between the leading edges of successive envelopes. The envelopes are transported by the belts 55, 57 and 59, which are under the drive influence of motor 49 through belt 83 and shaft 53, under the yoke roller 167 such that the leading edge of the lead envelopes engages the stack wall facing 115 and is caused assume a generally vertical position against the stack wall. The subsequent envelopes are caused to assume a generally parallel orientation relative to the lead envelope. The positioning of envelopes is assisted by the the edge engagement of the envelopes with the threaded hubs 101, 103 and 157.

As the envelopes are caused to vertically stack, edge engagement of the envelopes with the threaded hubs 101, 103 and 157 cause the stack wall 111 to displace outwardly. The rods 117, 119, 121, and 168 support the stacked envelopes as the stack wall is displaced.

The afore description is of the preferred embodiment of the present invention and should not be view as limiting to the invention. The scope of the invention is defined by the appendix claims.

What is claimed is:

1. A power stacker for collecting seriatim delivered envelopes of varying size and thickness, each of said envelopes having a leading and trailing edge, comprising:

a support housing;

an elongated deck fixably mounted horizontally along said housing, said deck having a front and rear end;

a registration wall fixably mounted to said housing and extending generally perpendicular to and along one side of said deck;

a stack wall slidably mounted to said housing at said rear end of said deck and having a reclined surface extending generally upwardly from said deck, said stack wall being slidably mounted to said housing such that said stack wall can be horizontally displaced outwardly from said deck;

support means slidably mounted to said housing for providing vertical envelope support between said deck and displaced stack wall;

first means for seriatimly causing said delivered envelop to travel along said deck until the trailing edge of said envelope arrives at a first position whereat said leading edge has been caused to be partially elevated by said reclined surface or previously delivered envelope;

second means for causing said envelope, upon arrival of said trailing edge to said first position, to further travel along said deck while causing said envelope to assume an orientation generally parallel to said stack wall and further causing said envelope to be forcibly biased against said stack wall until said stack wall is displaced outwardly a distance generally corresponding to the thickness of said envelope, said second means including, a first threaded hub rotatively mounted in said housing such that a portion of said hub engages the trailing edge of said envelope at said first position, said engagement to be maintained until said envelope has assumed an orientation generally parallel to said stack wall;

a second threaded hub rotatively mounted to said registration wall such that a portion of said hub engages a portion of said envelope to cause said envelope to be biased against said stack wall at said rear end of said deck and to cause said envelopes to maintain a parallel orientation with respect to said stack wall, and means for rotatively driving said first and second hubs.

2. A power stacker as claimed in claim 1 further comprising control means for controlling said first means such that envelopes received on said deck from an envelope feed device are aligned on said deck in a shingled fashion.

* * * * *